US009534567B2

(12) United States Patent
Ulrey et al.

(10) Patent No.: US 9,534,567 B2
(45) Date of Patent: Jan. 3, 2017

(54) DEDICATED EGR CYLINDER POST COMBUSTION INJECTION

(71) Applicant: Ford Global Technologies, LLC, Dearborn, MI (US)

(72) Inventors: Joseph Norman Ulrey, Dearborn, MI (US); James Douglas Ervin, Novi, MI (US); Brad Alan Boyer, Canton, MI (US); Daniel Joseph Styles, Canton, MI (US); Gregory Patrick McConville, Ann Arbor, MI (US); Kim Hwe Ku, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 866 days.

(21) Appl. No.: 13/915,445

(22) Filed: Jun. 11, 2013

(65) Prior Publication Data

US 2014/0360461 A1 Dec. 11, 2014

(51) Int. Cl.
*F02M 25/07* (2006.01)
*F02D 19/12* (2006.01)

(52) U.S. Cl.
CPC ..... *F02M 26/43* (2016.02); *F02D 19/12* (2013.01); *F02M 26/05* (2016.02)

(58) Field of Classification Search
CPC ..... F02D 17/02; F02D 19/12; F02D 21/06; F02D 21/08; F02D 2021/083; F02D 41/0047; F02D 41/005; F02D 41/0052; F02D 41/402; F02D 41/405; F02M 2026/001; F02M 26/41; F02M 226/43; F02M 2700/31; F02M 25/07; F02M 25/0715; F02M 25/0747; F02M 25/0749
See application file for complete search history.

(56) References Cited

U.S. PATENT DOCUMENTS

| | | | |
|---|---|---|---|
| 5,279,515 | A | 1/1994 | Moore et al. |
| 5,746,189 | A | 5/1998 | Kuzuya et al. |
| 6,053,154 | A | 4/2000 | Pott |
| 6,138,650 | A | 10/2000 | Bailey |
| 6,230,695 | B1 | 5/2001 | Coleman et al. |
| 6,293,246 | B1 | 9/2001 | Tamahashi et al. |
| 6,397,790 | B1 | 6/2002 | Collier, Jr. |
| 6,405,720 | B1 | 6/2002 | Collier, Jr. |

(Continued)

FOREIGN PATENT DOCUMENTS

WO 2014005127 A2 1/2014

OTHER PUBLICATIONS

Glugla, Chris P., "Systems and Methods for Boost Control," U.S. Appl. No. 14/307,165, filed Jun. 17, 2014, 56 pages.

(Continued)

*Primary Examiner* — Erick Solis
*Assistant Examiner* — Anthony L Bacon
(74) *Attorney, Agent, or Firm* — Julia Voutyras; Alleman Hall McCoy Russell & Tuttle LLP

(57) ABSTRACT

Systems and methods for increasing an amount of fuel injected into a dedicated exhaust gas recirculation (EGR) cylinder in an engine are disclosed. In one example approach, a method comprises, prior to combustion, injecting a first amount of fuel to a dedicated EGR cylinder, and after combustion and during an expansion and/or exhaust stroke, directly injecting a second amount of fuel to the dedicated EGR cylinder.

20 Claims, 4 Drawing Sheets

(56) References Cited

U.S. PATENT DOCUMENTS

| | | | | |
|---|---|---|---|---|
| 6,499,449 | B2 | 12/2002 | Michelini et al. | |
| 6,543,230 | B1 | 4/2003 | Schmid | |
| 6,655,324 | B2 | 12/2003 | Cohn et al. | |
| 6,820,415 | B2 | 11/2004 | Abet et al. | |
| 6,925,802 | B2 | 8/2005 | Arnold | |
| 6,968,825 | B2 | 11/2005 | Hitomi et al. | |
| 7,290,504 | B2 | 11/2007 | Lange | |
| 7,779,812 | B2 | 8/2010 | Leone et al. | |
| 7,942,127 | B2 | 5/2011 | Leone et al. | |
| 8,041,500 | B2 | 10/2011 | Leone | |
| 8,108,125 | B2 | 1/2012 | Leone | |
| 8,150,605 | B2 | 4/2012 | Doering et al. | |
| 8,239,122 | B2 | 8/2012 | Leone et al. | |
| 8,291,891 | B2 | 10/2012 | Alger, II et al. | |
| 8,352,160 | B2 | 1/2013 | Leone | |
| 8,352,164 | B2 | 1/2013 | Leone et al. | |
| 8,511,084 | B2 | 8/2013 | Ulrey et al. | |
| 8,539,768 | B2 | 9/2013 | Hayman et al. | |
| 8,561,599 | B2 | 10/2013 | Gingrich et al. | |
| 8,701,409 | B2 | 4/2014 | Pursifull et al. | |
| 8,763,570 | B2 | 7/2014 | Hayman et al. | |
| 9,279,393 | B2 * | 3/2016 | Boyer | F02D 41/0055 |
| 2005/0016496 | A1 | 1/2005 | Hitomi et al. | |
| 2009/0308070 | A1 | 12/2009 | Alger, II et al. | |
| 2011/0041495 | A1 | 2/2011 | Yager | |
| 2011/0253113 | A1 | 10/2011 | Roth et al. | |
| 2012/0023937 | A1 | 2/2012 | Styles et al. | |
| 2012/0078492 | A1 | 3/2012 | Freund et al. | |
| 2012/0204844 | A1 | 8/2012 | Gingrich et al. | |
| 2012/0240909 | A1 * | 9/2012 | Geyer | F02B 37/10 123/559.1 |
| 2012/0260897 | A1 | 10/2012 | Hayman et al. | |
| 2012/0285163 | A1 | 11/2012 | Hayman et al. | |
| 2012/0285426 | A1 | 11/2012 | Hayman et al. | |
| 2012/0285427 | A1 | 11/2012 | Hayman et al. | |
| 2012/0323465 | A1 * | 12/2012 | Peters | F02D 41/0082 701/104 |
| 2012/0323470 | A1 * | 12/2012 | Klingbeil | F02D 41/0065 701/108 |
| 2013/0008416 | A1 * | 1/2013 | Nagatsu | F02D 13/0265 123/568.11 |
| 2013/0220286 | A1 * | 8/2013 | Gingrich | F02D 41/0065 123/568.11 |
| 2014/0069082 | A1 * | 3/2014 | Alger, II | F02M 26/43 60/274 |
| 2014/0196697 | A1 * | 7/2014 | Burrahm | F02M 25/0718 123/568.11 |
| 2014/0196702 | A1 * | 7/2014 | Gingrich | F02D 41/0065 123/568.21 |
| 2015/0114341 | A1 * | 4/2015 | Geckler | F02D 41/0065 123/295 |

OTHER PUBLICATIONS

Martin, Douglas R. et al., "Method and System for EGR Control," U.S. Appl. No. 14/327,379, filed Jul. 9, 2014, 48 pages.

Potteau, Sebastian et al., "Cooled EGR for a Turbo SI Engine to Reduce Knocking and Fuel Consumption," SAE Technical Paper Series No. 2007-01-3978, Powertrain & Fluid Systems Conference and Exhibition, Rosemont, Ill., Oct. 29-Nov. 1, 2007, 13 pages.

Alger, Terry et al., "Dedicated EGR: A New Concept in High Efficiency Engines," SAE Technical Paper Series No. 2009-01-0694, Southwest Research Institute, 12 pages.

Boyer, Brad A. et al., "Devices and Methods for Exhaust Gas Recirculation Operation of an Engine," U.S. Appl. No. 13/744,281, filed Jan. 17, 2013, 33 pages.

Leone, Thomas G. et al., "Systems and Methods for Improving Operation of a Highly Dilute Engine," U.S. Appl. No. 14/271,248, filed May 6, 2014, 40 pages.

Leone, Thomas G. et al., "Systems and Methods for Dedicated EGR Cylinder Valve Control," U.S. Appl. No. 14/297,232, filed Jun. 5, 2014, 36 pages.

Leone, Thomas G. et al., "Systems and Methods for EGR Control," U.S. Appl. No. 14/298,733, filed Jun. 6, 2014, 45 pages.

* cited by examiner

DEDICATED EGR CYLINDER POST COMBUSTION INJECTION

BACKGROUND AND SUMMARY

Engines may be configured with exhaust gas recirculation (EGR) systems to divert at least some exhaust gas from an engine exhaust passage to an engine intake passage. By controlling EGR to provide a desired engine dilution, engine pumping work, engine knock, as well as NOx emissions may be reduced. For example, at partial throttle operating conditions, providing EGR to the cylinders of the engine allows for the throttle to be opened to a greater extent for the same engine load. By reducing throttling of the engine, pumping losses may be reduced, thus improving fuel efficiency. Further, by providing EGR to the engine, combustion temperatures may be reduced (especially in implementations where EGR is cooled prior to being provided to the cylinders). Cooler combustion temperatures provide engine knock resistance, and thus increase engine thermal efficiency. Further still, EGR reduces a combustion flame temperature that reduces an amount of NOx generated during combustion.

In some approaches, gas exhausted from only one or more of a subset of cylinders may be recirculated to provide EGR to all cylinders of the engine. For example, an EGR conduit may be coupled to an exhaust of a dedicated EGR cylinder so that exhaust from the dedicated cylinder is introduced into the intake manifold of the engine to provide EGR. In this way, a substantially fixed amount of EGR flow may be provided to the engine intake.

In such approaches which use dedicated EGR cylinders to provide EGR to the engine, the inventors herein have recognized that it may be desirable to run the dedicated EGR cylinder rich to increase ignitability of the air, fuel, EGR mixture. The ignitability may be improved due to the presence of hydrogen which is formed in the dedicated cylinder when running rich. Overly increasing the amount of fuel injected into the dedicated cylinder may lead to reduced combustion efficiency and/or increased smoke conditions during engine operation. For example, increasing richness in the EGR cylinder beyond that required for best combustion efficiency may cause smoke formation, and further increasing richness may reduce the ability to ignite the charge. As such, the amount of fuel that can be added to a dedicated EGR cylinder may be limited.

Thus, in one example, some of the above issues may be at least partly addressed by a method comprising, prior to combustion, injecting a first amount of fuel to a dedicated EGR cylinder, e.g., in an amount that provides an optimal combustion efficiency, and after combustion and during an expansion and/or exhaust stroke, directly injecting a second amount of fuel to the dedicated EGR cylinder. The first and second injections may be during a common cylinder combustion cycle, and may be repeatedly performed in successive cycles of the dedicated EGR cylinder.

In this way, an increased amount of fuel may be introduced into the EGR flow while maintaining good combustion with low soot formation. Further, in such an approach, pumping work at part-throttle for the remaining cylinders in the engine may be reduced via fuel evaporation in the dedicated EGR cylinder and fuel injectors in the remaining cylinders may be downsized resulting in cost savings and increased fuel efficiency. Further still, such an approach may be employed during engine cold start conditions while operating the dedicated cylinder in a lean mode when less than full EGR is desired. For example, to help with fuel vaporization, a small amount of fuel could be burned (via a stratified charge injection a during compression stroke of the dedicated EGR cylinder) to heat the air/cylinder and then fuel could be injected later in the cycle to improve evaporation of the fuel. In this way, fuel preparation, e.g., smoke reduction in direct injection applications, during warm-up of the engine may be improved.

It will be understood that the summary above is provided to introduce in simplified form a selection of concepts that are further described in the detailed description, which follows. It is not meant to identify key or essential features of the claimed subject matter, the scope of which is defined by the claims that follow the detailed description. Further, the claimed subject matter is not limited to implementations that solve any disadvantages noted above or in any part of this disclosure.

DETAILED DESCRIPTION

Figure 1:
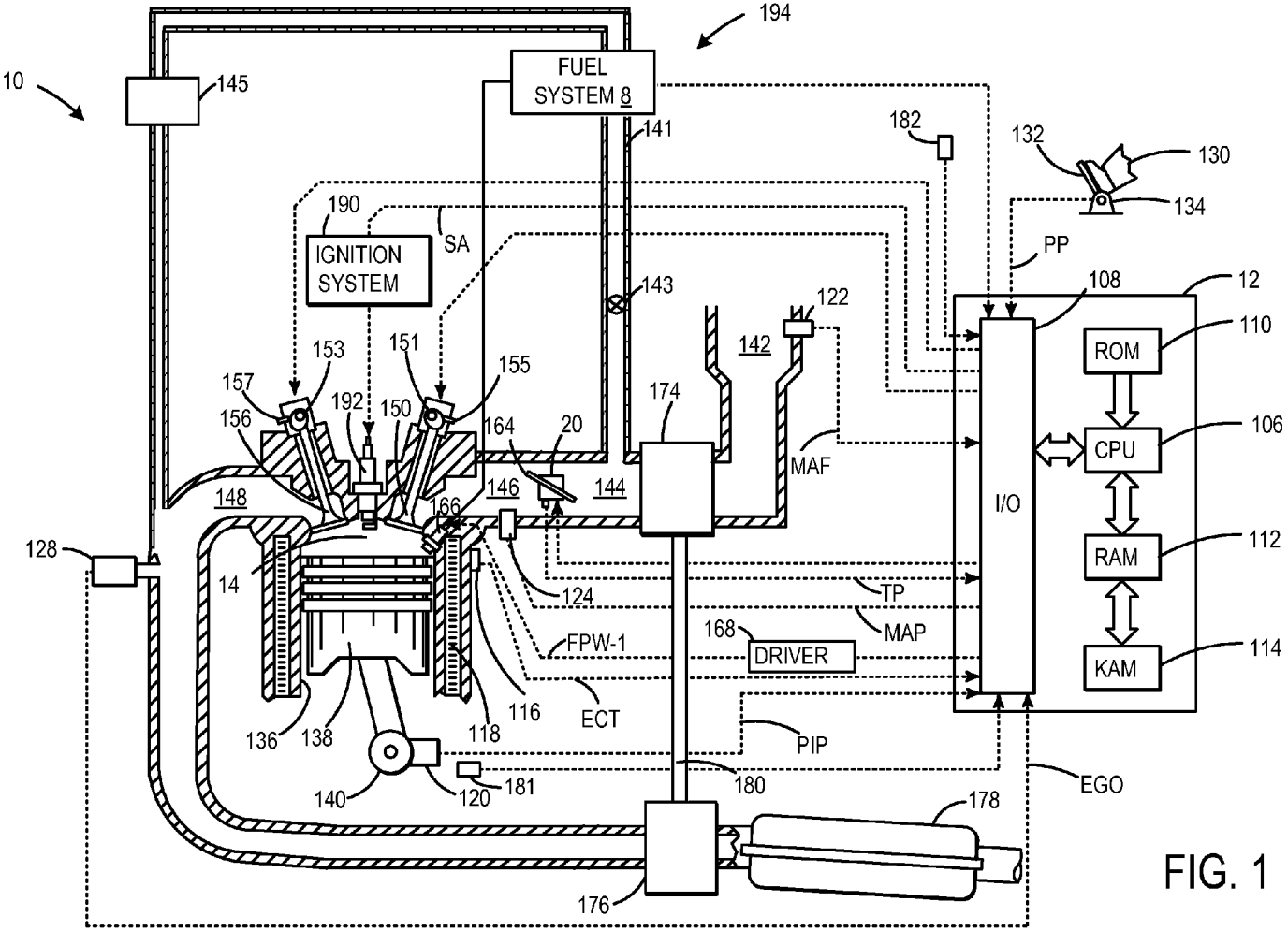
FIGS. 1 and 2 show an example engine system in accordance with the disclosure.
Figure 2:
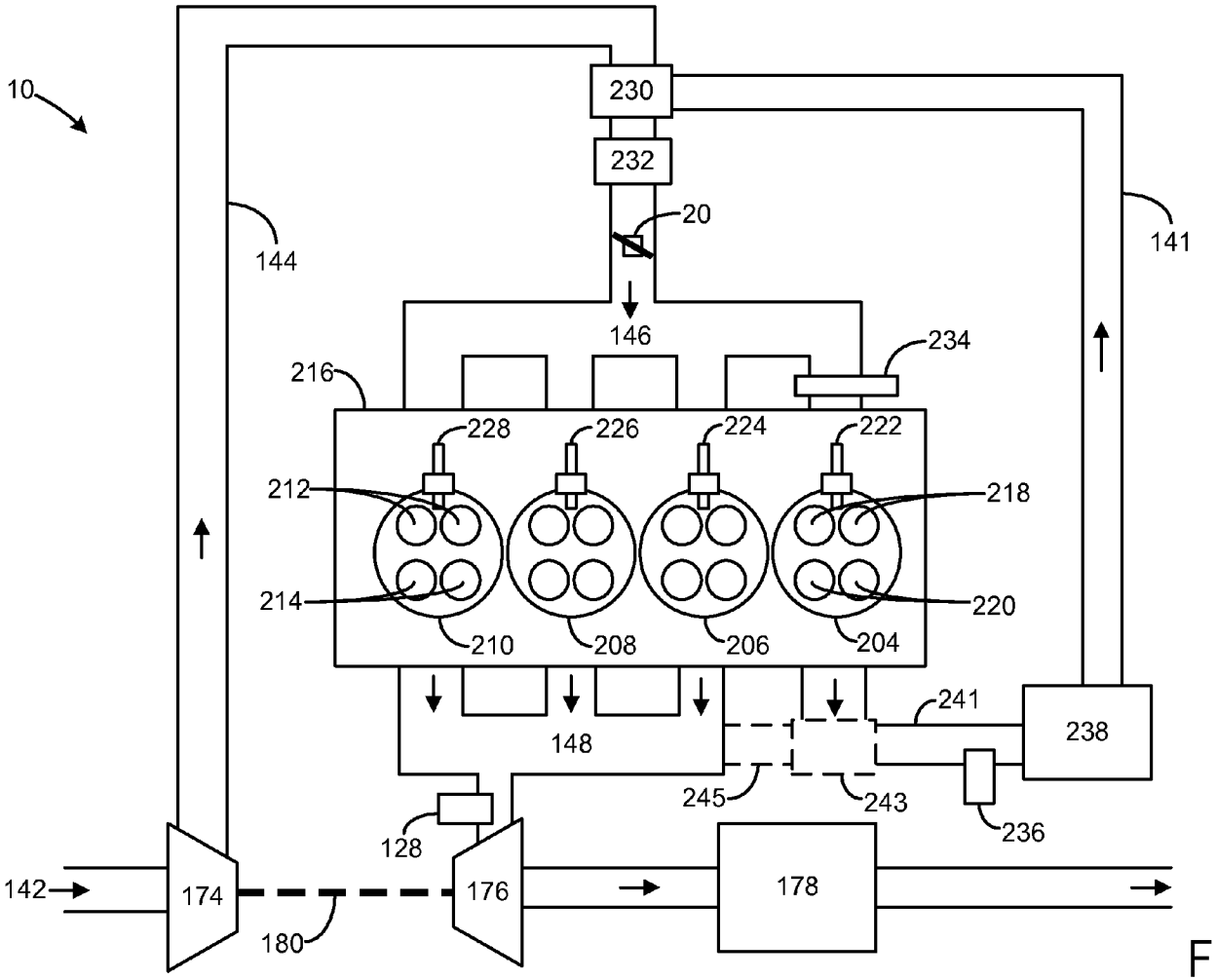
Figure 3:
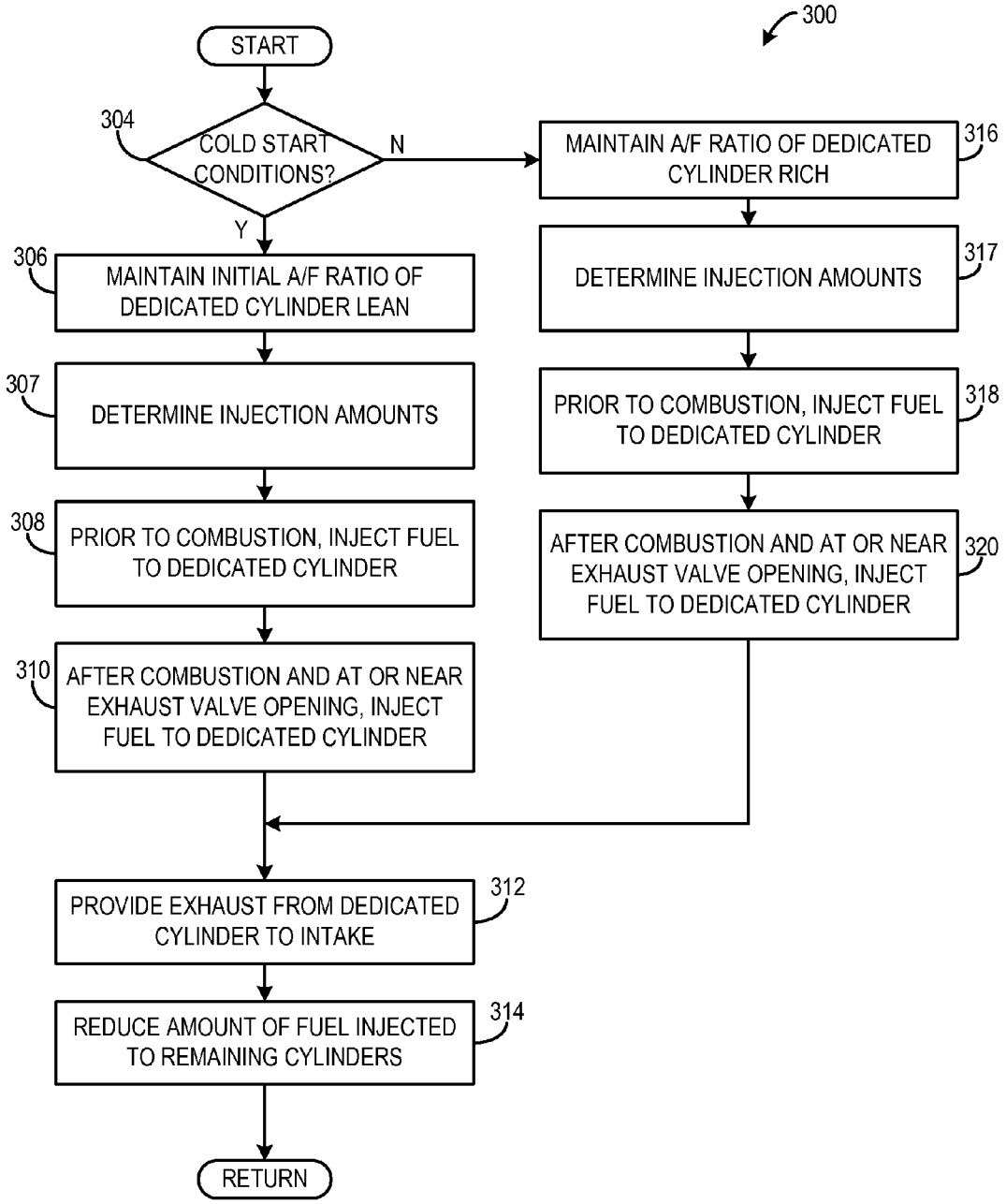
FIG. 3 shows an example method for post combustion injection in a dedicated EGR cylinder in accordance with the disclosure.
Figure 4:
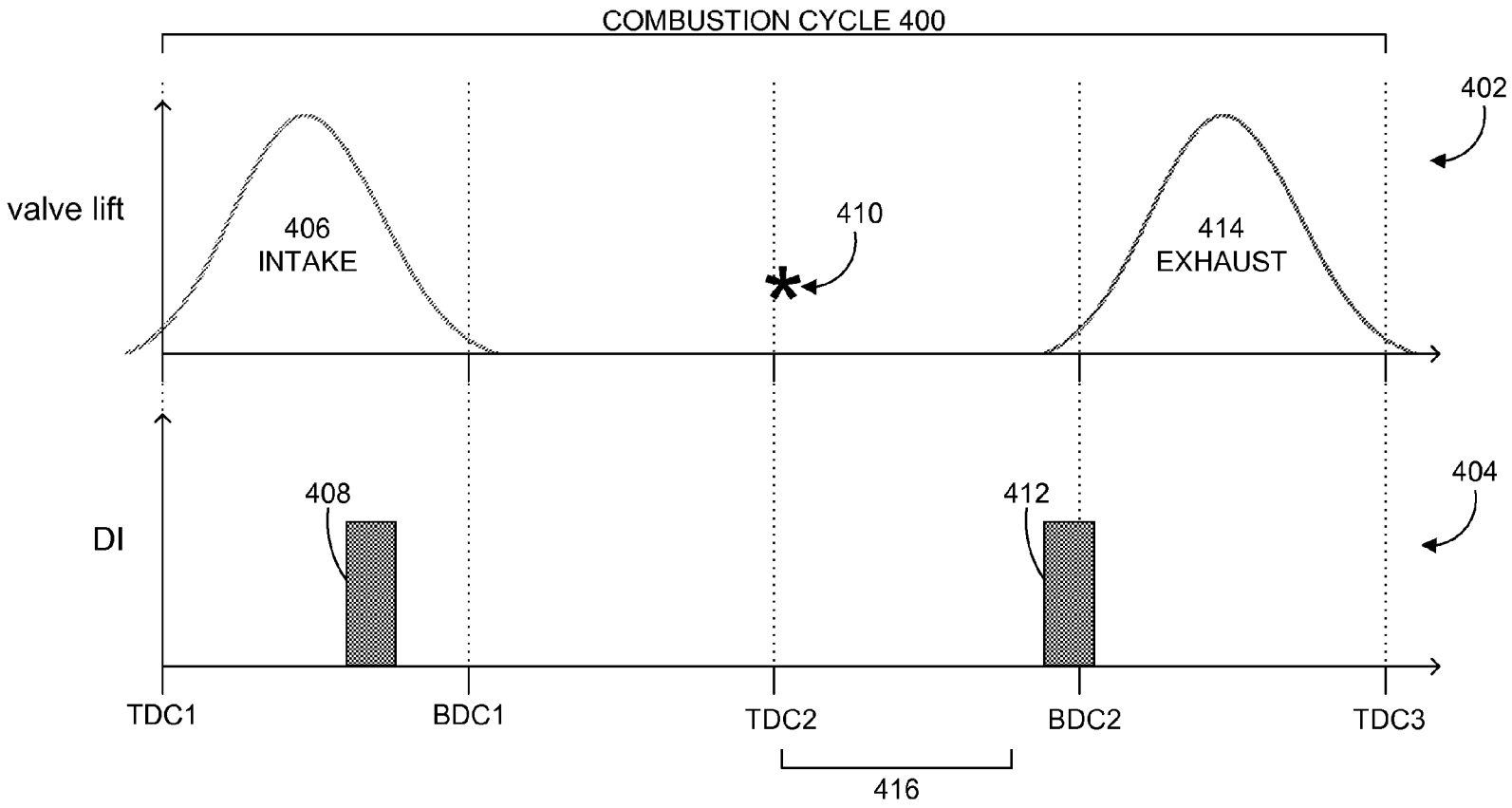
FIG. 4 illustrates an example method for post combustion injection in a dedicated EGR cylinder in accordance with the disclosure.

The present description is related to increasing an amount of fuel in an exhaust gas recirculation (EGR) flow in an engine, such as the engine system shown in FIG. 1. As shown in FIG. 2, an engine system may include a dedicated or donor cylinder from which EGR flow is drawn. For example, an exhaust of a dedicated EGR cylinder may be coupled to an intake of the engine to provide exhaust gas from the dedicated cylinder to all of the cylinders in the engine. As remarked above, it may be desirable to increase the richness in the dedicated EGR cylinder to increase ignitability of the mixture in each cylinder which includes this EGR However, increasing the amount of fuel injected into the dedicated cylinder may lead to reduced combustion efficiency and increased smoke or soot conditions during engine operation. For example, increasing richness in the EGR cylinder beyond that required for best combustion efficiency may cause smoke formation, and further increasing richness may reduce the ability to ignite the charge. As such, the amount of fuel that can be added to a dedicated EGR cylinder for combustion may be limited. As shown in FIGS. 3 and 4, in order to overcome these air/fuel limitations in the dedicated cylinder, additional fuel may be injected into the dedicated cylinder during post-combustion conditions in the cylinder, e.g., during the expansion and/or exhaust stroke. The timing of the injection will determine the temperature and pressure that the fuel encounters, and will affect the chemical reactions that take place. FIG. 1 depicts an example embodiment of a combustion chamber or cylinder of internal combustion engine 10. Engine 10 may receive control parameters from a control system including controller 12 and input from a vehicle operator 130 via an input device 132. In this example, input device 132 includes an accelerator pedal and a pedal position sensor 134 for generating a proportional pedal position signal PP. Cylinder (herein also "combustion chamber') 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor may be coupled to crankshaft 140 via a flywheel to enable a starting operation of engine 10.

Cylinder 14 can receive intake air via a series of intake air passages 142, 144, and 146. Intake air passage 146 may communicate with other cylinders of engine 10 in addition to cylinder 14. In some embodiments, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 20 including a throttle plate 164 may be provided along an intake passage of the engine for varying the flow rate and/or pressure of intake air provided to the engine cylinders. For example, throttle 20 may be disposed downstream of compressor 174 as shown in FIG. 1, or alternatively may be provided upstream of compressor 174. A charge air cooler, e.g., charge air cooler 232 shown in FIG. 2 described below, may be used in passage 144 or 146 to reduce the temperature and increase the density of the air entering the cylinder.

Exhaust passage 148 may receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Exhaust temperature may be measured by one or more temperature sensors (not shown) located in exhaust passage 148. Alternatively, exhaust temperature may be inferred based on engine operating conditions such as speed, load, air-fuel ratio (AFR), spark retard, etc. Further, exhaust temperature may be computed by one or more exhaust gas sensors 128. It may be appreciated that the exhaust gas temperature may alternatively be estimated by any combination of temperature estimation methods listed herein.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams and may utilize one or more of cam profile switching (CPS), variable cam timing (VCT), variable valve timing (VVT) and/or variable valve lift (VVL) systems that may be operated by controller 12 to vary valve operation. The operation of intake valve 150 and exhaust valve 156 may be determined by valve position sensors (not shown) and/or camshaft position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation including CPS and/or VCT systems. In still other embodiments, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. Conventionally, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock. Further, using high levels of EGR may also allow for increased compression ratios.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

Fuel injector 166 is shown coupled directly to cylinder 14 for injecting fuel directly therein in proportion to the pulse width of signal FPW received from controller 12 via electronic driver 168. In this manner, fuel injector 166 provides what is known as direct injection (hereafter also referred to as "DI") of fuel into combustion cylinder 14. While FIG. 1 shows injector 166 as a side injector, it may also be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a high pressure fuel system 8 including fuel tanks, fuel pumps, and a fuel rail. Alternatively, fuel may be delivered by a single stage fuel pump at lower pressure. Further, the fuel tanks may have a pressure transducer providing a signal to controller 12.

It will be appreciated that while in one embodiment, the engine may be operated by injecting fuel via a single direct injector; in alternate embodiments, the engine may be operated by using two injectors (a direct injector 166 and a port injector) and varying a relative amount of injection from each injector.

Fuel may be delivered by the injector to the cylinder during a single cycle of the cylinder. Further, the distribution and/or relative amount of fuel delivered from the injector may vary with operating conditions, such as engine temperature, ambient temperature, etc., as described herein below. Furthermore, for a single combustion event, multiple injections of the delivered fuel may be performed per cycle.

The multiple injections may be performed during the intake, compression, expansion or exhaust stroke, or any appropriate combination thereof.

As described above, FIG. 1 shows only one cylinder of a multi-cylinder engine. As such each cylinder may similarly include its own set of intake/exhaust valves, fuel injector(s), spark plug, etc.

Engine 10 may further include an EGR system 194 including one or more exhaust gas recirculation passages for recirculating a portion of exhaust gas from the engine exhaust to the engine intake. As such, by recirculating some exhaust gas, an engine dilution may be affected which may increase engine performance by reducing engine knock, peak cylinder combustion temperatures and pressures, throttling losses, and NOx emissions. In the depicted embodiment, exhaust gas may be recirculated from exhaust passage 148 to intake passage 144 via EGR passage 141. The amount of EGR provided to intake passage 148 may be varied by controller 12 via EGR valve 143. Further, an EGR sensor 145 may be arranged within the EGR passage and may provide an indication of one or more pressure, temperature, and concentration of the exhaust gas. An EGR cooler (not shown) may be included along EGR passage 141.

It will be appreciated that while the embodiment of FIG. 1 shows high pressure (HP-EGR) being provided via an HP-EGR passage coupled between the engine intake downstream of the turbocharger compressor and the engine exhaust upstream of the turbine, in alternate embodiments, the engine may be configured to also provide low pressure EGR (LP-EGR) via an LP-EGR passage coupled between the engine intake upstream of the compressor and the engine exhaust downstream of the turbine. In one example, an HP-EGR flow may be provided under conditions such as the absence of boost provided by the turbocharger, while an LP-EGR flow may be provided during conditions such as in the presence of turbocharger boost and/or when an exhaust gas temperature is above a threshold. When distinct HP-EGR and LP-EGR passages are included, the respective EGR flows may be controlled via adjustments to respective EGR valves.

Controller 12 is shown in FIG. 1 as a microcomputer, including microprocessor unit 106, input/output ports 108, an electronic storage medium for executable programs and calibration values shown as read only memory chip 110 in this particular example, random access memory 112, keep alive memory 114, and a data bus. For example, the ROM 110, RAM 112, or KAM 114, alone or in combination, may be representative of computer readable medium that is programmable to hold instructions that are executable by the processor 106 to control operation of engine 10. Controller 12 may receive various signals from sensors coupled to engine 10, in addition to those signals previously discussed, including measurement of inducted mass air flow (MAF) from mass air flow sensor 122; a profile ignition pickup signal (PIP) from Hall effect sensor 120 (or other type) coupled to crankshaft 140; throttle position (TP) from a throttle position sensor; and manifold absolute pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Still other sensors may include fuel level sensors and fuel composition sensors coupled to the fuel tank(s) of the fuel system.

Furthermore, controller 12 may receive signals that may be indicative of a various temperatures related to the engine 10. For example, engine coolant temperature (ECT) from temperature sensor 116 coupled to cooling sleeve 118 may be sent to controller 12. In some embodiments, sensor 128 may provide an indication of exhaust temperature to controller 12. Sensor 181 may provide an indication of oil temperature or oil viscosity to controller 12. Sensor 182 may provide an indication of ambient temperature to controller 12. One or more of these sensors may provide an indication of an engine temperature that may be used by controller 12 to control operation of the engine.

FIG. 2 shows another example engine system 10. Like-numbered elements shown in FIG. 2 correspond to like-numbered elements shown in FIG. 1 described above. In FIG. 2, the engine system includes an engine with a cylinder bank 216 including a plurality of cylinders, e.g., cylinder 204, cylinder 206, cylinder 208, and cylinder 210. Each cylinder shown in FIG. 2 may correspond to cylinder 14 shown in FIG. 1 described above. Each cylinder includes one or more intake valves, e.g., intake valves 212 in cylinder 210 and intake valves 218 in cylinder 204, and one or more exhaust valves, e.g., exhaust valves 214 in cylinder 210 and exhaust valves 220 in cylinder 204. Further, each cylinder may include a spark-plug coupled thereto so that the engine is a spark-ignited engine. For example, cylinder 210 includes spark plug 228, cylinder 208 includes spark plug 226, cylinder 206 includes spark plug 224, and cylinder 204 includes spark plug 222.

The engine system 10 shown in FIG. 2 includes a dedicated EGR cylinder 204 used to deliver EGR to an intake of the engine via EGR conduit 141. Thus, EGR conduit 141 may be coupled to an exhaust of cylinder 204 and may not be coupled to exhausts of the other remaining cylinders 206, 208, and 210. Further EGR conduit 141 may include an exhaust gas sensor 236 which may be selected from among various suitable sensors for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor.

EGR conduit 141 may further include a catalyst 238, e.g., a water gas shift catalyst used to convert carbon monoxide and water in the exhaust into carbon dioxide and hydrogen for combustion in the engine. EGR conduit 141 couples the exhaust from dedicated EGR cylinder 204 with intake passage 144 at a position upstream of throttle 20. As depicted in FIG. 2, the EGR is coupled to the intake manifold that feeds all cylinders of the engine including the dedicated EGR cylinder. In an alternate configuration, the dedicated EGR cylinder may have its own throttle and intake manifold, and may not receive EGR from its own exhaust passage. In this example, exhaust may be delivered from the dedicated EGR cylinder 204 to the engine intake 146 for delivery to the remaining cylinders, e.g., cylinders 206, 208, and 210. In some examples, a mixer 230 may be included at the junction where EGR conduit 141 is coupled to intake passage 144 to assist in mixing of EGR with intake air. Further, an intercooler or charge air cooler 232 may be included in the engine intake between throttle 20 and mixer 230 to assist in cooling EGR gases before they enter intake passages coupled to the engine cylinders via intake 146. The other or remaining cylinders 210, 208, and 206 which are not dedicated EGR cylinders and do not generate EGR for the engine are coupled via exhaust passage 148 to exhaust turbine 176. In an alternate configuration, the engine may include the ability to switch the routing of the exhaust from cylinder 204 to either passage 141 for recirculation or to passage 148 for no recirculation. For example, a valve 243 may optionally be coupled to an exhaust of the dedicated cylinder 204 where the valve 243 may be actuated to switch the routing of the exhaust from cylinder 204 to either passage 141 via conduit 241 for recirculation or to passage 148 via conduit 245 for no recirculation.

Fuel may be injected to the cylinders in a variety of ways, e.g., each cylinder may include a fuel injector, e.g., injector 166 shown in FIG. 1, coupled directly to cylinder to provide direct injection of fuel into the cylinder. However in other examples, port fuel injection may be used instead of or in addition to direct injection. The dedicated EGR cylinder 204 has a direct injector, and in some examples, may also include a port injector 234. However, in other examples, port injector 234 may be omitted so that fuel is only directly injected into dedicated EGR cylinder 204.

During engine operation, an amount of fuel may be injected into the dedicated EGR cylinder 204 so that the cylinder runs slightly rich to improve ignitability of the air/fuel/EGR mixture delivered to the engine via EGR conduit 141. For example, an amount of fuel may be injected into dedicated EGR cylinder during an intake stroke of a piston in the cylinder while one or more of intake valves 218 are opened prior to spark ignition and combustion in cylinder 204. In order to further improve combustion of the air/fuel/EGR mixture delivered to the engine it may be desirable to increase an amount of fuel injected into the dedicated EGR cylinder. However, as remarked above, increasing the amount of fuel injected into the dedicated cylinder prior to combustion may lead to reduced combustion efficiency and increased smoke or soot conditions during engine operation. For example, increasing richness in the EGR cylinder beyond that required for best combustion efficiency may cause smoke formation, and further increasing richness may reduce the ability to ignite the charge. As such, the amount of fuel that can be added to a dedicated EGR cylinder for combustion may be limited. As described below with regard to in FIGS. 3 and 4, in order to overcome these air/fuel limitations in the dedicated cylinder, additional fuel may be injected into the dedicated cylinder during post-combustion conditions in the cylinder, e.g., during the expansion and/or exhaust stroke.

FIG. 3 shows an example method 300 for post combustion injection in a dedicated EGR cylinder, e.g., cylinder 204 shown in FIG. 2, in order to overcome air/fuel limitations in the dedicated cylinder and to assist in fuel evaporation during cold start conditions. As shown in FIG. 2, the dedicated EGR cylinder may be coupled to an intake of the engine. Further, the engine may be a spark-ignited engine. The example combustion cycle 400 shown in FIG. 4 will be described concurrently with FIG. 3 to illustrate post combustion injection in the dedicated EGR cylinder during a combustion cycle 400 under various conditions. At 402, FIG. 4 shows a graph of intake and exhaust valve lift versus piston position in the cylinder as the piston oscillates between a top dead center (TDC) position and a bottom dead center (BDC) position. At 404, FIG. 4 shows fuel injection into the dedicated EGR cylinder versus piston position.

At 304, method 300 includes determining if cold start conditions are present. For example, cold start conditions may comprise engine operating conditions when an engine temperature is less than a threshold temperature. As an example, cold start conditions may occur following a vehicle key-on event when an engine is started from rest. During such cold start conditions, it is common to run an engine with retarded spark timing in order to decrease the effective work done on the piston for a given amount of heat created through combustion. Much of the heat created late in the expansion stroke exits the exhaust port to quickly heat up the catalyst which improves tailpipe emissions. Since the exhaust from the dedicated EGR cylinder will be recirculated to the intake of the engine, that cylinder can be run rich and can include direct fuel injection after combustion. Fuel injected after combustion will immediately vaporize in the hot gas, alleviating the challenges of fuel vaporization during cold starting conditions.

If cold start conditions are present at 304, method 300 proceeds to 306. At 306, method 300 includes injecting a first amount of fuel prior to combustion that results in an overall pre-combustion lean air/fuel ratio, but might be near stoichiometric near the spark plug due to stratification. For example, as illustrated in the example combustion cycle 400 shown in FIG. 4, during a first injection event 408, a first amount of fuel may be injected into the dedicated cylinder prior to combustion, e.g., during an intake stroke of the piston in the cylinder as the piston moves from a top dead center position (TDC1) to a bottom dead center position (BDC1) while one or more cylinder intake valves are at least partially open as indicated at 406 in FIG. 4. The first amount of fuel injected during the first injection event 408 prior to combustion may be chosen to provide an air/fuel ratio in the cylinder less than stoichiometry. This first amount of fuel injected into the dedicated cylinder prior to combustion may be based on various engine operating conditions, e.g., a temperature of the engine, and engine speed, engine load, etc. The timing of spark ignition in the dedicated EGR cylinder may be advanced compared to the other cylinders such that the work done by the smaller amount of fuel earlier in the cycle in the EGR cylinder is similar to the work done on the piston later in the cycle with a near stoichiometric mixture in the other cylinders.

In order to assist with fuel evaporation during cold start conditions while the engine is warming up, an additional, second amount of fuel may be injected during a second injection event 412 into the dedicated cylinder after a combustion event 416 occurs in the dedicated cylinder, e.g., after a spark event 410 during an expansion stroke when the piston in the cylinder moves from top dead center (TDC2) to bottom dead center (BDC2) in the cylinder at or near an opening 414 of one or more exhaust valves in the cylinder. This second amount of fuel injected into the cylinder may also be based on various engine operating conditions, e.g., engine temperature, engine speed, and engine load. Further, this second amount of fuel injected into the dedicated cylinder may be based on the first amount of fuel injected prior to combustion. For example, an increased amount of fuel may be injected post combustion in response to a decreased amount of fuel injected prior to combustion.

Thus, at 307, method 300 includes determining fuel injection amounts. For example, the amount of fuel injected prior to combustion (the first amount injected during injection event 408) and the amount of fuel injected post combustion (the second amount injected during second injection event 412) may be determined based on various engine operating conditions such as engine temperature, engine load, engine speed, the air/fuel ratio in the EGR, the air/fuel ratio in the intake manifold, etc. Engine operating conditions used to determine the fuel injection amounts may be further based on various other parameters such as engine/cylinder temperature, ambient temperature, exhaust temperature, engine dilution, an amount of boost, etc.

After determining the pre and post combustion fuel injection amounts, at 308, method 300 includes, prior to combustion, injecting fuel to the dedicated EGR cylinder. For example, prior to combustion, the first amount of fuel injected during the first injection event 408 may be directly injected to the dedicated EGR cylinder. However, in other examples, prior to combustion, the first amount of fuel injected during the first injection event 408 may be injected via a port fuel injector to the dedicated EGR cylinder. At 310, method 300 includes, after combustion and at or near exhaust valve opening, directly injecting fuel to the dedicated EGR cylinder. For example, after combustion and at or near exhaust valve opening 414, the second amount of fuel injected during the second injection event 412 may be injected to the dedicated EGR cylinder. Further, substantially no fuel may be injected between injection of the first fuel amount during the first injection event 408 and injection of the second fuel amount during the second injection event 412. In other words, fuel injection may not be continuous between the two injection events.

At 312, method 300 includes providing exhaust from the dedicated EGR cylinder to the intake system of the engine. For example, exhaust may be delivered from the dedicated EGR cylinder 204 to the engine intake 146 for delivery to all of the cylinders, e.g., cylinders 204, 206, 208, and 210 for combustion therein. In some examples, at 314, method 300 may include reducing an amount of fuel injected to the remaining cylinders. For example, fuel injection amounts in the other remaining cylinders may be adjusted to accommodate an increased amount of fuel in the EGR to achieve a target air/fuel ratio in the remaining engine cylinders while maintaining combustion stability. For example, an amount of fuel injected into the other remaining cylinders, e.g., cylinders 206, 208, and 210, may be reduced to compensate for an increased amount of fuel in the EGR from the second injection event 412. In the limiting case, the amount of fuel injected in the remaining cylinders may be zero if sufficient fuel is provided by the EGR. Similarly, the amount of fuel injected in the first injection, e.g., first injection 408 shown in FIG. 4 described below, to the dedicated EGR cylinder may be reduced to compensate for the amount of fuel in the EGR.

As remarked above, the engine may include the ability to switch the routing of the exhaust from cylinder 204 to either passage 141 for recirculation or to passage 148 for no recirculation. For example, a valve 243 may optionally be coupled to an exhaust of the dedicated cylinder 204 where the valve 243 may be actuated to switch the routing of the exhaust from cylinder 204 to either passage 141 via conduit 241 for recirculation or to passage 148 via conduit 245 for no recirculation. Thus, in some examples, following directly injecting fuel to the dedicated EGR cylinder in step 310, providing EGR from the dedicated EGR cylinder to the intake may be discontinued, e.g., by actuating valve 243 to switch the routing of the exhaust from cylinder 204 to passage 148 via conduit 245 for no recirculation.

Returning to 304, if cold start conditions are not present at 304, method 300 proceeds to 316. For example, after the engine is warmed-up and/or if the engine temperature is greater than the threshold temperature described above, then method 300 proceeds to 316. At 316, method 300 includes maintaining an air/fuel ratio of the dedicated EGR cylinder rich. For example, an amount of fuel injected into the dedicated EGR cylinder may be increased so that the air fuel ratio of the dedicated EGR cylinder is rich with an air/fuel ratio greater than stoichiometry during engine operation.

For example, as illustrated in the example combustion cycle 400 shown in FIG. 4, a third amount of fuel may be injected during a first injection event 408 into the dedicated cylinder prior to combustion, e.g., during an intake stroke of the piston in the cylinder as the piston moves from a top dead center position (TDC1) to a bottom dead center position (BDC1) while one or more cylinder intake valves are at least partially open as indicated at 406 in FIG. 4. The third amount of fuel injected during first injection event 408 may be greater than the first amount of fuel injected prior to combustion during cold start conditions as described above. This third amount of fuel injected prior to combustion may be chosen to provide an air/fuel ratio in the cylinder greater than stoichiometry and may be based on various engine operating conditions, e.g., a temperature of the engine, and engine speed, engine load, etc.

In order to increase an amount of fuel including carbon monoxide and hydrogen in the EGR to improve combustion, an additional, fourth amount of fuel may be injected during a second injection event 412 into the dedicated cylinder after a combustion event 416 occurs in the dedicated cylinder, e.g., after a spark event 410 during an expansion stroke when the piston in the cylinder moves from top dead center (TDC2) to bottom dead center (BDC2) in the cylinder at or near an opening 414 of one or more exhaust valves in the cylinder. This fourth amount of fuel injected into the cylinder may be also be based on various engine operating conditions, e.g., engine temperature, engine speed, and engine load. Further, this fourth amount of fuel injected into the dedicated cylinder may be based on the third amount of fuel injected prior to combustion so that the amount of fuel in the EGR provided by the dedicated cylinder maintains rich operating conditions. For example, an increased amount of fuel may be injected post combustion in response to a decreased amount of fuel injected prior to combustion.

Thus, At 317, method 300 includes determining fuel injection amounts. For example, the amount of fuel injected prior to combustion (the third amount injected during the first injection event 408) and the amount of fuel injected post combustion (the fourth amount injected during the second injection event 412) may be determined based on various engine operating conditions such as engine temperature, engine load, engine speed, the air/fuel ratio in the EGR, the air/fuel ratio in the intake manifold, etc. Engine operating conditions used to determine the fuel injection amounts may be further based on various other parameters such as engine/cylinder temperature, ambient temperature, exhaust temperature, engine dilution, an amount of boost, etc.

In some examples, the third amount of fuel injected during the first injection event 408 prior to combustion may be increased and the fourth additional amount of fuel injected during the second injection event 412 post combustion may be adjusted based on engine operating conditions such as engine speed and/or engine load. For example, the third amount of fuel injected prior to combustion may be chosen so that the air/fuel ratio in the dedicated cylinder is greater than stoichiometry after injection of the third amount and the fourth additional amount of fuel injected post combustion may be adjusted based on engine operating conditions such as engine speed and/or engine load. However, during some operating conditions, the third amount of fuel injected prior to combustion may be sufficient to meet a target air/fuel ratio demand and no additional fuel may be injected post combustion.

As another example, the third amount of fuel injected prior to combustion may be increased to a limit value, e.g., a limit corresponding to an air/fuel ratio of 12:1 in the dedicated cylinder, and the fourth additional amount of fuel injected post combustion may be adjusted based on engine operating conditions such as engine speed and/or engine load. As still another example, the third amount of fuel injected prior to combustion may be chosen so that the air/fuel ratio in the dedicated cylinder is substantially equal to stoichiometry after injection of the third amount, and the fourth additional amount of fuel injected post combustion may be adjusted based on engine operating conditions such as engine speed and/or engine load.

After determining the pre and post combustion fuel injection amounts At 318, method 300 includes, prior to combustion, injecting fuel to the dedicated EGR cylinder. For example, prior to combustion, the third amount of fuel may be directly injected during the first injection event 408 to the dedicated EGR cylinder. At 320, method 300 includes, after combustion and at or near exhaust valve opening, injecting fuel to the dedicated EGR cylinder. For example, after combustion and at or near exhaust valve opening 414, the fourth amount of fuel may be injected to the dedicated EGR cylinder during the second injection event 412. Further, substantially no fuel may be injected between injection of the third fuel amount and injection of the fourth fuel amount. In other words, fuel injection may not be continuous between the two injection events 408 and 412. The timing of the fuel injected in the second injection event may be varied as a function of engine operating conditions such as speed, load, injection amount, exhaust valve timing, etc.

At 312, method 300 includes providing exhaust from the dedicated EGR cylinder to the other remaining cylinders in the engine. For example, exhaust may be delivered from the dedicated EGR cylinder 204 to the engine intake 146 for delivery to all of the cylinders, e.g., cylinders 204, 206, 208, and 210 for combustion therein. In some examples, at 314, method 300 may include reducing an amount of fuel injected to the remaining cylinders. For example, fuel injection amounts in the other remaining cylinders may be adjusted to accommodate an increased amount of fuel in the EGR to achieve a target air/fuel ratio in the remaining engine cylinders while maintaining combustion stability. For example, an amount of fuel injected into the other remaining cylinders, e.g., cylinders 206, 208, and 210, may be reduced to compensate for an increased amount of fuel in the EGR from the second injection event 412. Similarly, the amount of fuel injected in the first injection 408 to the dedicated EGR cylinder may be reduced to compensate for the amount of fuel in the EGR.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:
determining a cold start condition;
if cold start conditions are determined not to be present:
prior to combustion, injecting a first amount of fuel to a dedicated EGR cylinder; and after combustion and during an expansion and/or exhaust stroke directly injecting a second amount of fuel to the dedicated EGR cylinder; and
if cold start conditions are determined to be present:
prior to combustion, injecting a third amount of fuel to the dedicated EGR cylinder; after combustion and at or near exhaust valve opening, directly injecting a fourth amount of fuel to the dedicated EGR cylinder; and maintaining a pre-combustion air fuel ratio of the dedicated EGR cylinder lean during the cold start conditions.

2. The method of claim 1, wherein the engine is a spark-ignited engine.

3. The method of claim 1, further comprising maintaining a rich air fuel ratio in the dedicated EGR cylinder if cold start conditions are determined not to be present.

4. The method of claim 1, further comprising providing EGR from the dedicated EGR cylinder to an intake of the engine and, following directly injecting the second amount of fuel to the dedicated EGR cylinder, discontinuing providing EGR from the dedicated EGR cylinder to the intake.

5. The method of claim 1, further comprising providing EGR from the dedicated EGR cylinder to all of the cylinders or the remaining engine cylinders.

6. The method of claim 1, wherein, after injection of the second amount of fuel, a combustion air fuel ratio limit in the dedicated EGR cylinder is exceeded.

7. The method of claim 1, further comprising reducing an amount of fuel injected into the remaining cylinders after directly injecting the second amount of fuel to the dedicated EGR cylinder.

8. The method of claim 1, wherein an exhaust of the dedicated EGR cylinder is coupled to an intake of the engine.

9. The method of claim 1, wherein the third amount is less than the first amount.

10. A method for an engine, comprising:
determining a cold start condition;
during engine cold start conditions:
prior to combustion, injecting a first amount of fuel to a dedicated EGR cylinder;
after combustion and at or near exhaust valve opening, directly injecting a second amount of fuel to the dedicated EGR cylinder, the first and second injections during a common cylinder combustion cycle and repeatedly performed in successive cycles of the dedicated EGR cylinder; and maintaining a pre-combustion air fuel ratio of the dedicated EGR cylinder lean during the cold start conditions; and following the cold start conditions:

prior to combustion, injecting a third amount of fuel to the dedicated EGR cylinder; after combustion and at or near exhaust valve opening, directly injecting a fourth amount of fuel to the dedicated EGR cylinder; and maintaining a rich air fuel ratio in the dedicated EGR cylinder.

11. The method of claim 10, wherein the cold start conditions comprise an engine temperature less than a threshold temperature.

12. The method of claim 10, wherein the second amount of fuel is injected to the dedicated EGR cylinder during an expansion and/or exhaust stroke.

13. The method of claim 10, wherein the engine is a spark-ignited engine.

14. The method of claim 10, further comprising providing EGR from the dedicated EGR cylinder to all of the cylinders or the remaining engine cylinders.

15. The method of claim 10, wherein the third amount of fuel is greater than the first amount of fuel and wherein, after injection of the fourth amount of fuel, a combustion air fuel ratio limit in the dedicated EGR cylinder is exceeded.

16. A method for a spark-ignited engine, comprising:

determining a cold start condition;

during engine cold start conditions:

prior to combustion, injecting a first amount of fuel to a dedicated EGR cylinder;

after combustion and at or near exhaust valve opening, directly injecting a second amount of fuel to the dedicated EGR cylinder;

maintaining an air fuel ratio of the dedicated EGR cylinder lean during the cold start conditions; and following the cold start conditions:

prior to combustion, injecting a third amount of fuel to the dedicated EGR cylinder;

after combustion and at or near exhaust valve opening, directly injecting a fourth amount of fuel to the dedicated EGR cylinder; and maintaining a rich air fuel ratio in the dedicated EGR cylinder.

17. The method of claim 16, wherein the cold start conditions comprise an engine temperature less than a threshold temperature.

18. The method of claim 16, wherein the second amount of fuel and the fourth amount of fuel are injected to the dedicated EGR cylinder during an expansion and/or an exhaust stroke.

19. A method, comprising:

determining a cold start condition;

responsive to a determination of cold start conditions when less than full EGR is desired; prior to combustion, injecting multiple fuel amounts to a dedicated EGR cylinder and maintaining a pre-combustion air fuel ratio of the dedicated EGR cylinder lean; and responsive to a determination of no cold start, injecting multiple fuel amounts to the dedicated EGR cylinder and maintaining a post-combustion air fuel ratio in the dedicated EGR cylinder rich.

20. The method of claim 19, wherein the lean pre-combustion air fuel ratio includes burning fuel via a stratified charge injection during a compression stroke of the dedicated EGR cylinder.

* * * * *